United States Patent [19]
Tochihara
[11] 4,198,088
[45] Apr. 15, 1980

[54] REMOVABLE DOOR LOCK

[76] Inventor: Joe I. Tochihara, 4586 Everest Cir., Cypress, Calif. 90630

[21] Appl. No.: 944,774

[22] Filed: Sep. 22, 1978

[51] Int. Cl.[2] ..... E05C 19/18
[52] U.S. Cl. ..... 292/288; 292/291; 292/294; 292/DIG. 15
[58] Field of Search ..... 292/288, 289, 291-294, 292/342, 343, 339, 162, 149, 258, DIG. 15

[56] References Cited

U.S. PATENT DOCUMENTS

| | | | |
|---|---|---|---|
| 1,054,386 | 2/1913 | Barton | 292/DIG. 15 X |
| 3,069,217 | 12/1962 | Kors | 292/288 X |
| 3,367,700 | 2/1968 | Carnicero | 292/288 |
| 3,929,362 | 12/1975 | Petroff | 292/291 |
| 3,938,839 | 2/1976 | Collier | 292/258 |

*Primary Examiner*—William E. Lyddane
*Attorney, Agent, or Firm*—William C. Babcock

[57] ABSTRACT

Disclosed herein is a door lock attachable to the edge of a door and selectively deployable to engage the floor adjacent the door to thereby prevent the door from opening. More specifically, the door lock comprises a slide adapted to be clamped to the door, the slide engaging a vertical leg of an L-shaped bracket, the horizontal leg thereof being provided with a plurality of V-shaped cuts forming downwardly directed teeth for engaging the floor or the carpet adjacent the door. Included also in the horizontal leg are two adjustable screws which may be turned downwardly to provide further engagement with the floor.

3 Claims, 5 Drawing Figures

FIG. 2
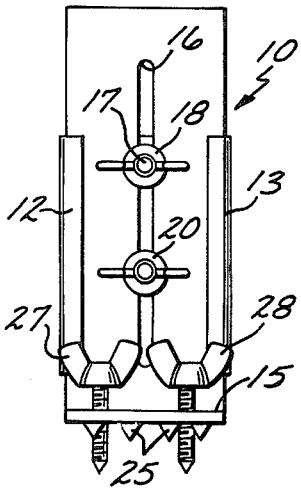
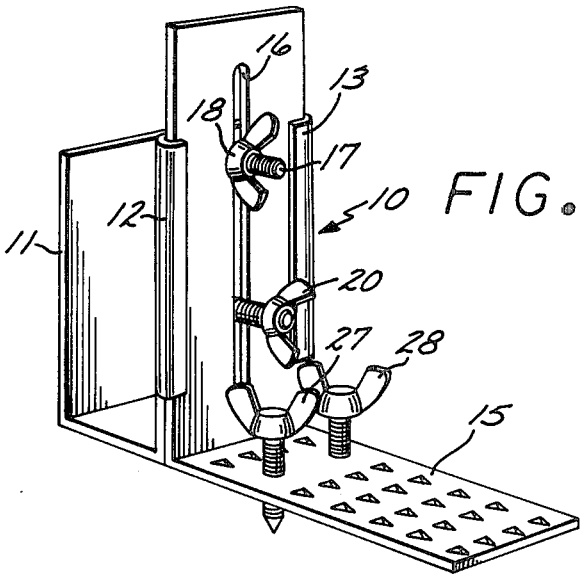
FIG. 1
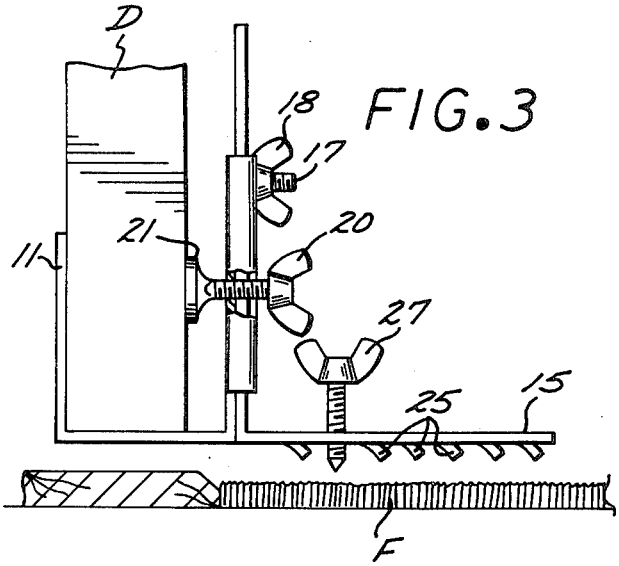
FIG. 3
FIG. 5
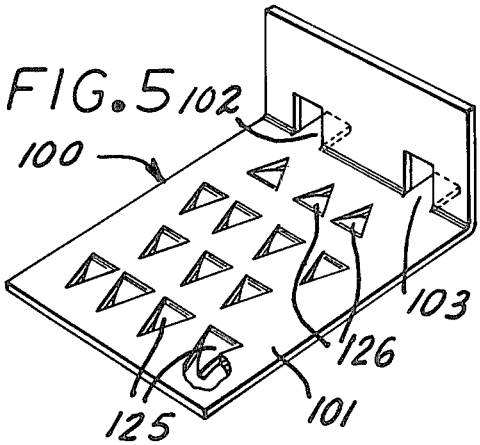
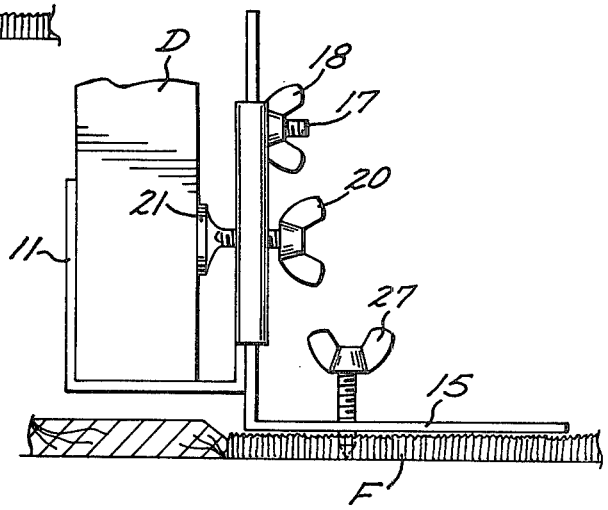
FIG. 4

REMOVABLE DOOR LOCK

BACKGROUND OF THE INVENTION

1. Field of the Invention

The present invention relates to door locking mechanisms, and more particularly to mechanisms attached to the edges of a door for securing the motion thereof.

2. Description of the Prior Art

With the present increase in crimes against property, and particularly with the increase in the incidents of burglaries, various securing devices have been developed to protect the modes of ingress and egress from a dwelling. Typically such devices have been frequently conformed to engage various holes or other openings in a door or a window and therefore entailed modification of the door structure in the use thereof. In many instances such modifications are not permitted by the landowner, thus limiting the use thereof and leaving the tenant often unprotected. For this reason selectively attachable devices which in their use do not require modification of the door have had recent demand and it is a device of this kind that is presently set out.

SUMMARY OF THE INVENTION

Accordingly, it is the general purpose and object of the present invention to provide a door lock assembly which by virtue of its structure may be selectively attached to the edge of a door.

Other objects of the invention are to provide a securing mechanism adapted to be deployed between the edge of the door and the surrounding structure which, by virtue of its features, will oppose the normal opening motion of the door.

Yet further objects of the invention are to provide a door securing device which is easy to produce, convenient in use and requires no maintenance.

Briefly these and other objects are accomplished within the present invention by providing a generally U-shaped clamping slide conformed to engage the edge of a door and including a clamping screw extending therethrough for attachment to the door. Formed along the edges of one leg of the slide are two inwardly-turned slips having received therebetween an L-shaped stop bracket provided with a set screw for selective adjustment of the deployment height thereof. The horizontal leg of the L-shaped bracket includes a plurality of V-shaped cuts, each forming a tooth-like structure, the tooth-like structures being bent out of the plane to form downwardly directed teeth which may be pressed into the flooring to secure the door. In addition the horizontal leg is also provided with two thumb screws engageable in the flooring which may assist in the securing thereof or in the process of withdrawal.

The foregoing structure is uniquely adapted for various temporary uses, and can be carried along by persons traveling for use in hotel rooms and other temporary lodging.

BRIEF DESCRIPTION OF THE DRAWING

FIG. 1 is a perspective illustration of a removable door lock constructed according to the present invention;

FIG. 2 is a front view of the door lock shown in FIG. 1 illustrating the manipulative deployment thereof;

FIG. 3 is a side view of the inventive door lock as installed onto the edge of a door, said door lock being articulated out of latching engagement to permit the opening of the door;

FIG. 4 is a side view of the inventive door lock manipulated to a locking engagement; and FIG. 5 is yet another perspective illustration of an alternate door lock adapted for transported use.

DESCRIPTION OF THE PREFERRED EMBODIMENT

As shown in FIGS. 1, 2 and 3, the inventive door lock assembly, generally designated by the numeral 10, comprises a U-shaped clamp 11 having an opening dimension somewhat greater than the thickness of a door D. One vertical leg of the U-shaped clamp 11, and particularly the leg deployed on the interior surface of the door, is provided with two opposed edge lips 12 and 13 extending partly along the lateral edges thereof conformed to receive therebetween, in sliding translation, the vertical element of an L-shaped bracket 15. This same vertical leg of bracket 15 also includes a centrally located longitudinal slot 16 through which a screw 17 engaged to the adjacent surface of clamp 11 extends. Screw 17 threadably engages a wing nut 18 and it is by this wing nut that selective adjustment of the deployment height of the bracket 15 is made. Extending also through slot 16 and threadedly engaged in clamp 11 is a thumb screw 20 terminating on the interior of the clamp in a clamping foot 21 for providing the clamping force against the door D. The horizontal leg of the L-shaped bracket 15 includes a plurality of V-shaped cuts each forming a tooth-like structure 25, the apex of each tooth being directed downwardly out of the surface of this leg.

As shown in FIG. 4 it is these tooth-like structures 25 that engage the flooring F adjacent the door thus precluding the inward articulation of the door. In addition, the horizontal leg of the bracket 15 may be provided with additional two thumb screws 27 and 28 terminating in spiked ends on the lower surface thereof, thumb screws 27 and 28 providing additional engagement with the flooring F and furthermore by the threaded engagement thereof relative the bracket 15 provide the necessary upward forces in order to withdraw the teeth from the flooring to thus permit opening. More specifically in the normal unengaged configuration the horizontal leg of bracket 15 is carried above the surface of the flooring with the teeth out of engagement. Should secure closing be desired the user may release the wing nut 18 and force the bracket 15 downwardly by stepping on the horizontal surface thereof. Once so located the wing nut 18 may then be again secured and the acute angle alignment of teeth 25 will then propagate into the flooring on the inward forcing of the door. Should withdrawal be desired the thumb screws 27 and 28 may be threadably advanced through the horizontal leg of bracket 15 forcing the teeth 25 out of engagement and allowing for manual upward articulation of the bracket.

By virtue of the foregoing arrangement of parts a substantially simple locking structure is achieved which does not require elaborate machining or modification of the door structure. This same arrangement of parts may cooperate with soft flooring like rugs, the number of teeth and the area of the horizontal leg of bracket 15 being sufficient to provide the necessary resistive forces against unwanted opening of the door.

As a further alternative a portable door stop useful with carpeted floors is set out in FIG. 5. In this illustration a single L-shaped bracket 100 is provided with a plurality of downwardly inclined teeth 125 formed in the horizontal surface 101 thereof. The horizontal surface 101 extends in the form of tabs 102 and 103 beyond the crook of the "L" and it is these tabs that are insertable between the lower edge of the door and the door sill. When so positioned the teeth 125, by virtue of their alignment, are driven into any fibrous floor covering, effecting a door closure.

This last implementation is of particular utility to those in the course of travel, being conveniently transportable and easily applied. Teeth 125 directed against the path of opening are maintained in contact with the floor covering by an opposed set of teeth 126, thus presenting a point which is imbedded by the door.

Obviously many modifications and changes may be made to the foregoing description without departing from the spirit of the invention. It is therefore intended that the scope of the invention be determined solely on the claims appended hereto.

What is claimed is:

1. A door securing device adapted to oppose the opening of a door comprising:

a U-shaped clamp conformed to engage the edge of said door said clamp including one vertical surface provided with outwardly directed inturned lips along two parallel edges thereof;

clamping means for releasably securing said clamp to said door;

an L-shaped bracket having a vertical leg conformed for insertion between said inturned lips and a horizontal leg provided with a plurality of V-shaped cuts each forming a tooth-like structure turned out of the plane of said horizontal leg; and adjusting means for selectively securing said bracket relative said clamp.

2. Apparatus according to claim 1 wherein said clamping means includes a thumbscrew threadably engaged to said clamp and aligned to extend to the interior thereof.

3. Apparatus according to claim 2 further comprising:

a screw extending through the horizontal leg for engaging the structure adjacent said door.

* * * * *